US006718864B2

(12) United States Patent
Abe et al.

(10) Patent No.: US 6,718,864 B2
(45) Date of Patent: Apr. 13, 2004

(54) CLOSED COMPRESSOR

(75) Inventors: Nobuo Abe, Oohira (JP); Gen Konno, Oohira (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/281,158

(22) Filed: Oct. 28, 2002

(65) Prior Publication Data

US 2003/0116013 A1 Jun. 26, 2003

(30) Foreign Application Priority Data

Dec. 20, 2001 (JP) ..... 2001-386898

(51) Int. Cl.[7] ..... F04B 39/00; F16J 1/22
(52) U.S. Cl. ..... 92/155; 92/187
(58) Field of Search ..... 92/155, 158, 159, 92/160, 187

(56) References Cited

U.S. PATENT DOCUMENTS 3,482,487 A * 12/1969 Leffers ..... 92/187
3,871,782 A 3/1975 Johansson
4,279,041 A 7/1981 Buchholz
4,913,001 A * 4/1990 Watanabe et al. ..... 92/160
5,048,993 A * 9/1991 Yoon ..... 92/187
5,118,263 A * 6/1992 Fritchman ..... 92/158
6,450,297 B1 * 9/2002 Kim ..... 92/160

FOREIGN PATENT DOCUMENTS

| | | |
|---|---|---|
| DE | 4024319 | 2/1991 |
| GB | 460644 | 1/1937 |
| JP | 53-106906 | 9/1978 |

* cited by examiner

*Primary Examiner*—Thomas E. Lazo
(74) *Attorney, Agent, or Firm*—Antonelli, Terry, Stout & Kraus, LLP

(57) ABSTRACT

In a closed compressor provided with a ball joint, there was needed a structure easy to assemble and capable of sufficiently supplying the lubricating oil to a ball joint section in order to ensure smooth sliding between a ball and a ball seat. The closed compressor is provided with a ball joint section. In the ball joint section, flat cut portions are formed in the outside diameter of the ball of the connecting rod, parallel with the end face of a ring. Also a groove is formed for insertion of the ball into the ball seat from the end of the crankshaft side which is an open end of the piston. The groove has the same width as the width between the flat cut portions of the ball.

11 Claims, 11 Drawing Sheets

CLOSED COMPRESSOR

FIELD OF THE INVENTION

The present invention relates to a closed compressor in which a connecting rod is connected to a piston with a ball of the connecting rod seated in a ball seat formed in the piston.

BACKGROUND OF THE INVENTION

As a conventional technology, there has been a closed compressor as disclosed in JP-B No. H2-36794.

In FIG. 19 showing the conventional technology of the closed compressor used in a refrigeration cycle, an electric motor 22 and a compressor mechanism section 23 are housed in a closed housing 21.

The compressor mechanism section 23 has an eccentrically rotating crankshaft 26 on the top end of a shaft 25 axially supported on a frame 24. A piston 28 reciprocally sliding in the cylinder 27 is connected to the crankshaft 26 through a connecting rod 29.

The connecting rod 29 and the piston 28, as shown in FIG. 20, are connected through a ball joint 30.

The connecting rod 29 includes a rod portion 33 on both ends of which a ball portion 31 and a ring portion 32 which is connected with the crankshaft 26 are fixedly attached.

The piston 28 is provided with a ball seat 34 in which the ball portion 31 of the connecting rod 29 seats. Before the ball portion 31 seats in the ball seat 34, a cover section provided at the ball seat 34 for covering the ball portion 31 is in the open position to allow insertion of the ball portion 31. After the insertion of the ball portion 31 into the ball seat 34 with the cover section in the open position, the spreading cover section of the ball seat 34 is closed and caulked (to cover the ball portion 31), so that the rod portion 33 fixedly jointed to the ball portion 31 may be rockably connected to the ball seat 34.

The ball portion 31 slides in the ball seat 34 during the operation of the closed compressor. Therefore, it is necessary to supply a lubricating oil between the ball portion 31 and the ball seat 34.

SUMMARY OF THE INVENTION

As a structure for supplying the lubricating oil between the ball portion 31 and the ball seat 34 stated above in JP-B No. H2-36794, a lubricating oil supply passage is formed by creasing the cover section of the ball seat 34 which covers the ball portion 31.

However, the structure for supplying the lubricating oil between the ball portion 31 and the ball seat 34 stated in JP-B No. H2-36794 has such a disadvantage as the lack of general versatility because a special caulking tool is needed.

There, however, are cases where, if the special tool is used, the lubricating oil supply passage of desired shape is unobtainable depending upon the opened state of the cover section of the ball seat 34.

In view of the above-described disadvantage, it is an object of this invention to provide a structure which will facilitate the assembly of the piston (ball seat) and the connecting rod (ball) and the smooth supply of lubricating oil to the ball and the ball seat.

To achieve the object, this invention has the structure that the ball portion of the connecting rod is provided with a flat section parallel with the end surface of the ring, and the piston is provided with a groove section which enables the insertion of the ball into the ball seat.

The groove section is desired to have at least the same width as the ball portion of the connecting rod which has a flat section.

Furthermore, the groove section should be formed long enough to reach at least the maximum-diameter portion of the ball seat. Since a ring portion is joined to the crankshaft which eccentrically rotates in relation to the shaft, the connecting rod assembled to the piston moves principally in a direction perpendicular to the shaft in accordance with the eccentric rotation of the crankshaft. It is, therefore, desirable to assemble the groove section of the piston in a position parallel to the shaft.

Because of the above-described structure, there is formed a space between the groove section of the piston and the flat cut portion of the connecting rod. This space serves as a lubricating oil inlet to the ball joint section. During the operation of the closed compressor, the ball section must be kept within the ball seat against the relative rotation of the piston and the connecting rod. To keep the ball section within the ball seat, it is desirable to provide a rotation restricting member for regulating the free rotation of the piston in relation to the connecting rod. The rotation restricting member must not interfere with smooth supply of the lubricating oil to the ball seat. If the lubricating oil is applied by splash-lubrication from the end of the crankshaft, it is desirable to adopt the structure that the space formed between the groove section of the piston on the crankshaft end side and the flat cut portion of the connecting rod is opened.

DETAILED DESCRIPTION OF THE PREFERRED EMBODIMENTS

Description will be given below in detail of preferred embodiments of this invention with reference to FIG. 1 to FIG. 18.

Figure 1:
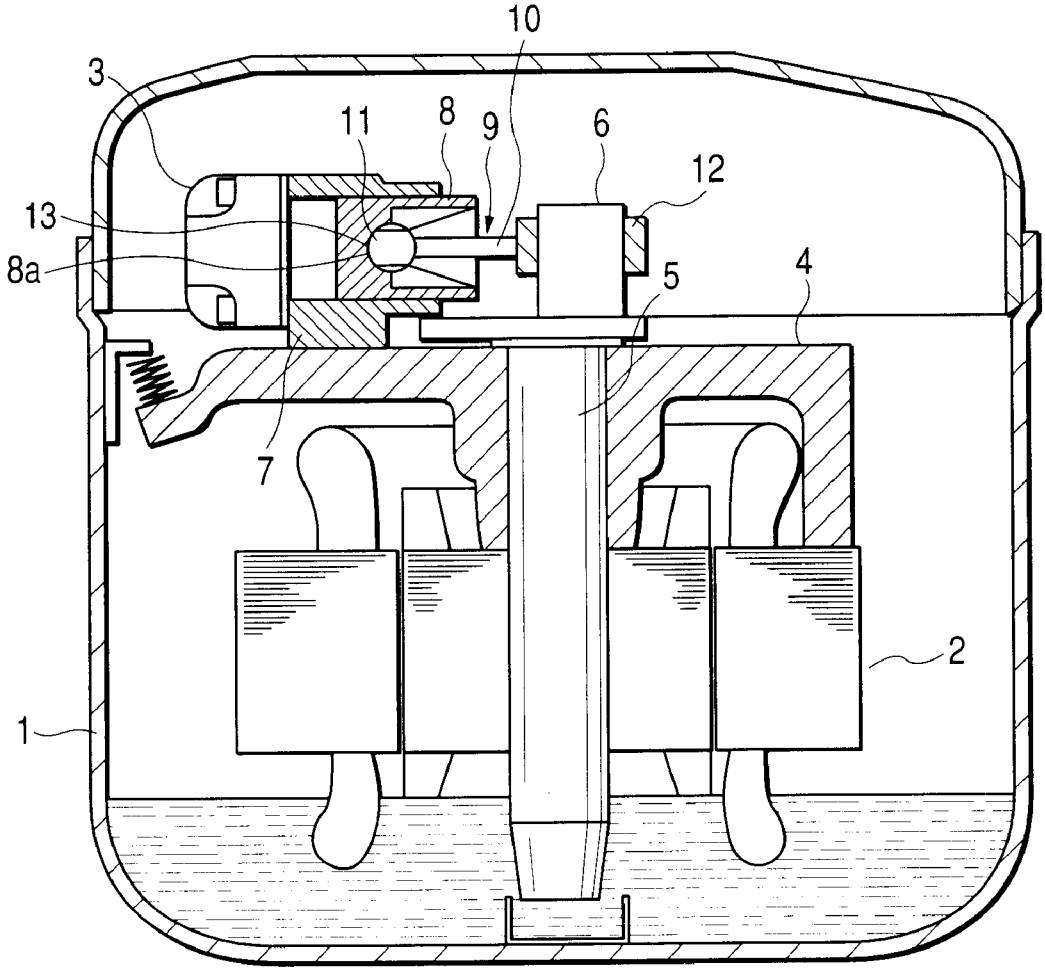
FIG. 1 is a longitudinal sectional view showing an example of a ball joint method of a closed compressor according to this invention.

FIG. 1 is a longitudinal sectional view showing an example the assembly structure of a closed compressor of this invention. Inside the closed housing 1 are installed an electric motor 2 and a compressor mechanism section 3. A frame 4 supports the electric motor 2 and the compressor mechanism section 3 inside of the closed housing 1. A shaft 5 with a rotor of the electric motor 2 fixed thereon is supported on the frame 4. On the upper end of the shaft 5 is mounted a crankshaft 6. To drive a piston 8 in a cylinder 7, a ball joint section 13 for joining between the crankshaft 6 and the piston 8 is comprised of a ball seat 8*a* of the piston 8 and a ball 11 of a connecting rod 9. The connecting rod 9 includes a rod portion 10, the ball 11 fixedly joined to one end of the rod portion 10, and a ring 12 which is fixedly mounted on the other end of the rod portion 10 and slides on the crankshaft 6.

In the closed compressor for use in the refrigeration cycle, as previously stated, the electric motor 2 and the compressor mechanism section 3 are housed in the closed housing 1.

The compressor mechanism section 3 is disposed on the upper end of the shaft 5 which is axially supported by the frame 4. The compressor mechanism section 3 is comprised of the eccentrically rotating crankshaft 6, the piston 8 reciprocally slided in the cylinder 7, and the connecting rod 9 including the ring 12 connected to the crankshaft 6 and the ball 11 connected to the piston 8 which are fixedly connected to the rod portion 10 into one unit.

The connecting rod 9 and the piston 8, as shown in FIG. 1, are connected by the ball joint section 13 which is an assembly of the ball 11 and the ball seat 8*a* of the piston 8.

Figure 2:
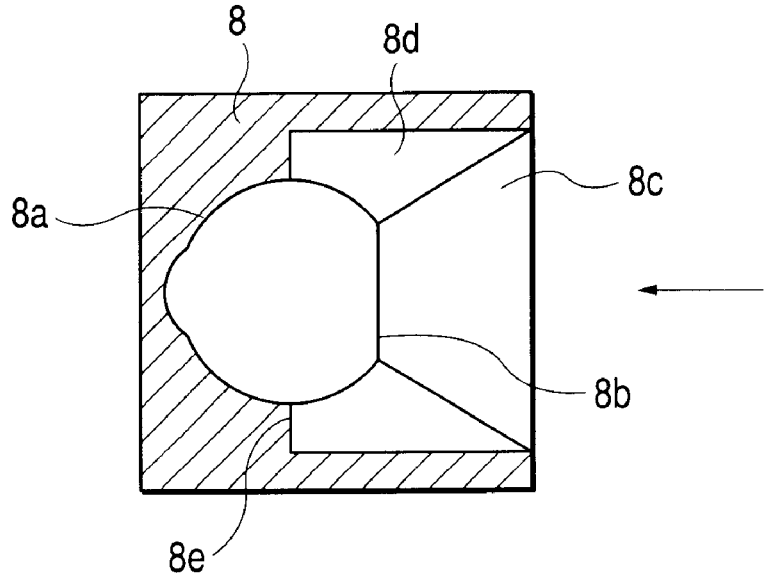
FIG. 2 is a longitudinal sectional view showing an example of the shape of a piston according to this invention.
Figure 3:
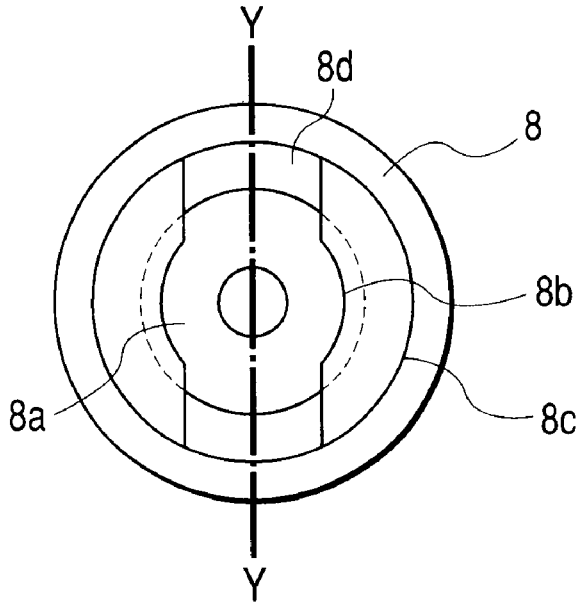
FIG. 3 is a side view of the piston seen from the direction of an arrow in FIG. 2.

FIG. 2 is a longitudinal sectional view showing an example of the shape of the piston 8 according to this invention. FIG. 3 is a side view seen from the direction of arrow of FIG. 2.

Figure 4:
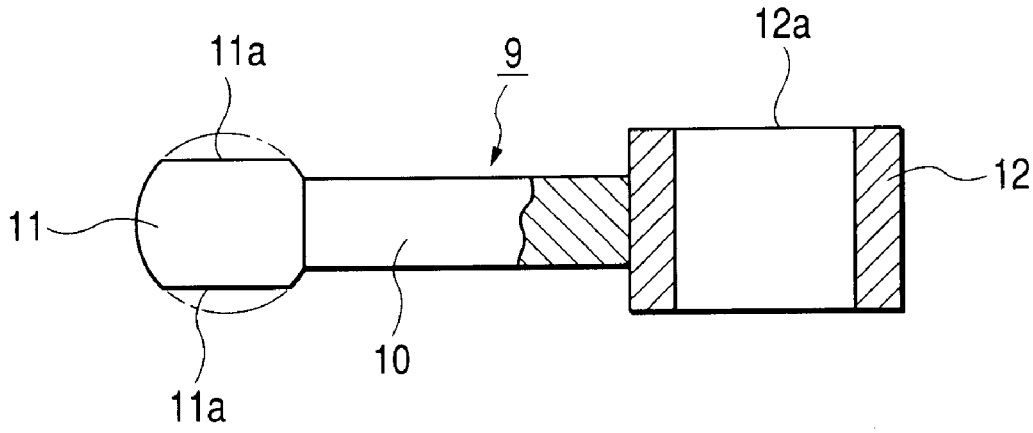
FIG. 4 is a longitudinal sectional view showing an example of a connecting rod according to this invention.

FIG. 4 is a longitudinal sectional view showing an example of the shape of configuration of the connecting rod 9 including three members.

That is, the piston 8 is provided with the ball seat 8*a* in which the ball 11 of the connecting rod 9 is placed. The piston 8 is also provided with a hole 8*c* extending in a shape of funnel toward the piston end face side from the opening section 8*b* (FIG. 3) which is freely made smaller in diameter than the inside diameter of the ball seat 8*a*.

Furthermore, the insertion groove 8*d* is an insertion port through which the ball 11 is inserted, and is formed symmetrically to the centerline Y—Y of the piston 8, with the bottom 8*e* extending to a position on an extension from the center of the ball diameter of the ball seat 8*a*.

The connecting rod 9 is of such a configuration that the ball 11 is joined on one end of the rod portion 10 and the ring 12 on the other end by welding or other. The ball 11 has flat cut portion 11*a*, which is provided by removing the upper and lower portions of the ball indicated by broken lines. The flat cut portion 11*a* is formed in parallel with the end faces 12*a* of the ring 12, that is, in parallel with the upper and lower surfaces. The flat cut portion 11*a* may not necessarily be parallel, but is desired to be formed in parallel from the viewpoint of the shape of the opening section 8*b* of the piston 8 and the strength of the ball joint section 13 as described later.

Figure 5:
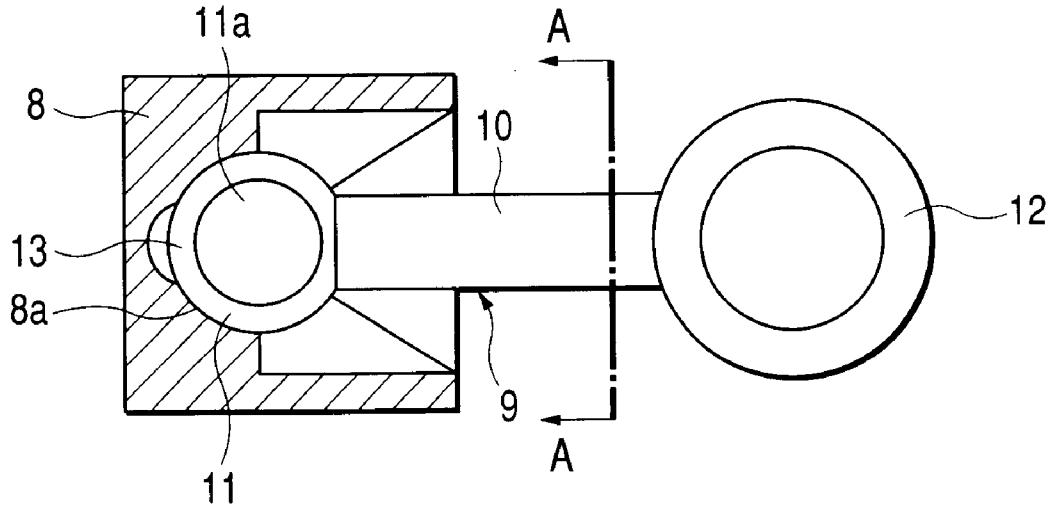
FIG. 5 is a longitudinal sectional view showing an example of method for assembling the piston and the connecting rod according to this invention.
Figure 6:
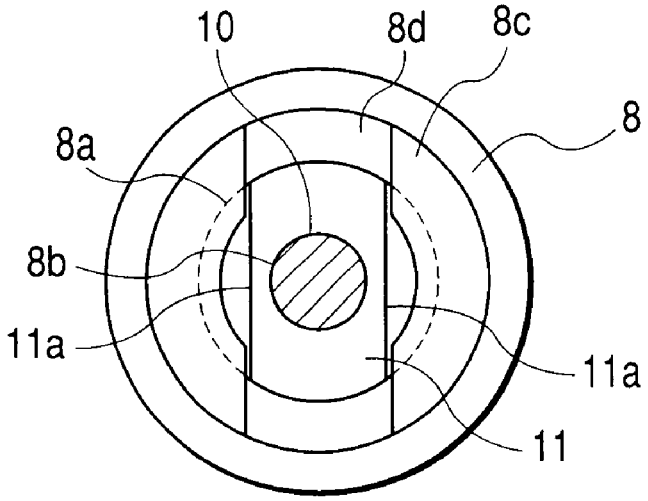
FIG. 6 is a sectional view taken along line A—A of FIG. 5.

FIGS. 5, 6, 7 and 8 show the method of assembling the piston 8, the connecting rod 9 and the ball joint section 13. FIG. 5 is a longitudinal sectional view indicating the ball joint section 13 with the connecting rod 9 inserted into the piston 8 and also with the ring 12 tilted about 90 degrees to the direction in which the ring 12 is actually used in the closed compressor (with the ring 12 vertically tilted). FIG. 6 is a sectional view taken along line A—A of FIG. 5.

First, as shown in FIG. 6, the flat cut portion 11*a* of the connecting rod 9 is aligned with the insertion groove 8*d* of the piston 8, then the ball 11 is inserted, being closely seated in the ball seat 8*a* as shown in FIG. 5.

Figure 7:
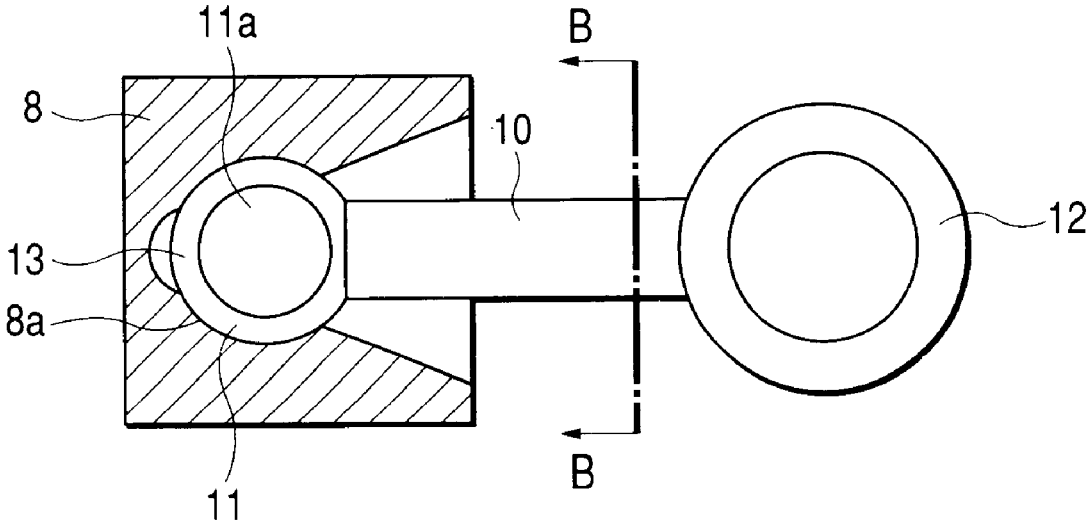
FIG. 7 is a transverse sectional view showing an example of method for assembling the piston and the connecting rod according to this invention.
Figure 8:
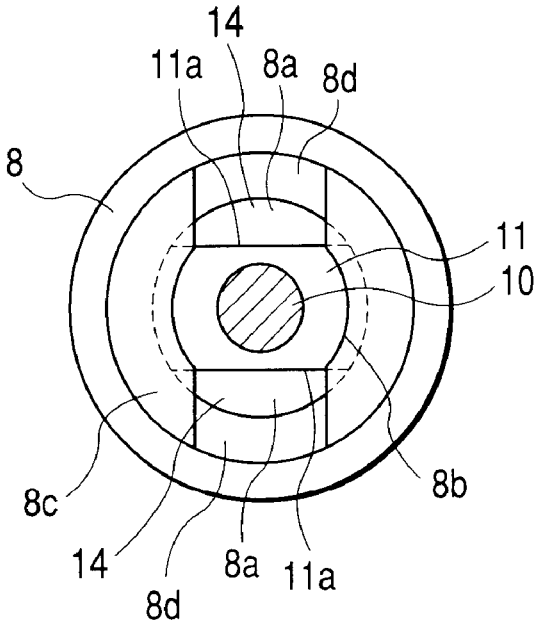
FIG. 8 is a sectional view taken along line B—B of FIG. 7.

Furthermore, as shown in FIGS. 7 and 8, the piston 8 and the connecting rod 9 are turned through about 90 degrees, thereby completing the ball joint section 13 without disconnection of the ball 11 from the opening section 8*b* which is smaller in diameter than the ball 11. FIG. 7 is a transverse sectional view of the cylinder 7 and the connecting rod 9 in FIG. 1. FIG. 8 is a sectional view taken along line B—B of FIG. 7. There is formed a space 14 between the insertion groove 8*d* of the piston 8 and the flat cut portion 11*a* of the ball 11, exposing a part of the ball seat 8*a* therethrough.

Figure 9:
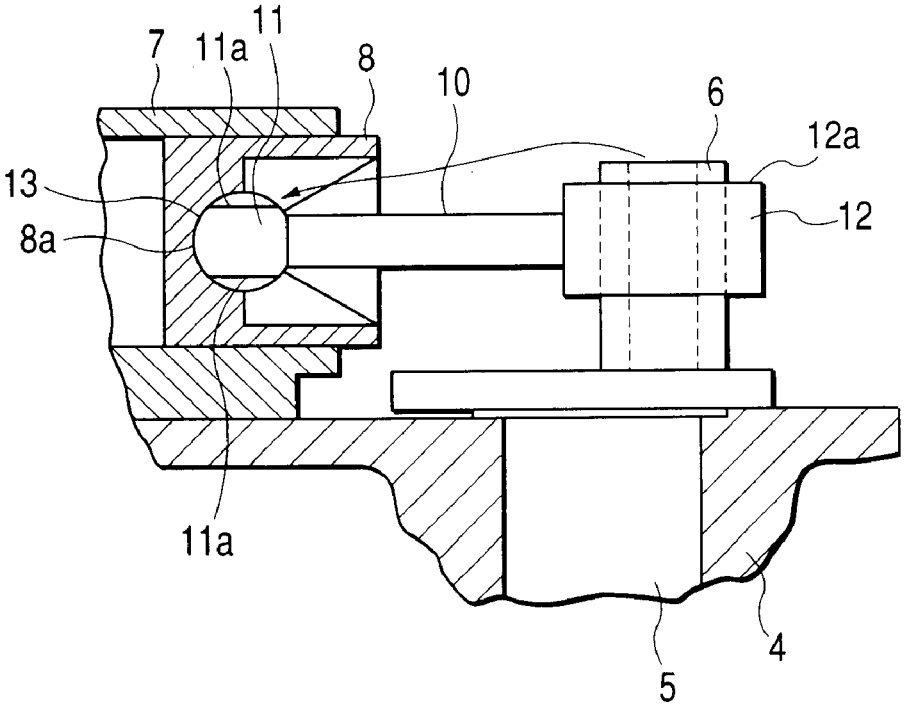
FIG. 9 is a longitudinal sectional view showing an example of method of lubrication to the ball joint section of the closed compressor according to this invention.

With the closed compressor installed, as shown in FIG. 9, the lubricating oil squirted from the forward end of the crankshaft 6 is supplied sufficiently to the ball seat 8*a* as indicated by an arrow, ensuring the reliability of sliding motion of the ball joint section 13.

That is, the lubricating oil drawn up from an oil reservoir passes through the shaft 5 and a hole provided in the crankshaft, being squirted from the forward end of the crankshaft 6. The lubricating oil thus squirted partly flows along the rod portion 10 of the connecting rod 9 toward the inside of the piston 8. The lubricating oil that has entered the piston 8 flows along the hole 8*c* of the piston 8 into the space 14 formed by the insertion groove 8*d* and the flat cut portion 11*a* of the ball 11. Further in the present embodiment, the ball seat 8*a* is sufficiently lubricated with the lubricating oil squirted to a space which communicates with the space 14 formed by the ball seat 8*a* and the flat cut portion 11*a*.

In the present embodiment, the insertion port of the piston 8 may be constituted also by inserting and fixing as large a block as the hole 8*c* which extends in a shape of funnel toward the end face of the piston, from the opening section 8*b* which is freely made smaller in diameter than the inside diameter of the ball seat 8*a*, or also by forming the insertion groove later.

However, in the case of the assembled ball joint section 13 described above, the piston 8 is freely rotatable in relation to the ball 11 during operation. With the operation of the compressor, a force acts on the piston 8, which rotates in relation to the connecting rod 9. If the insertion groove 8*d* of the piston 8 is aligned with the flat cut portion 11*a* of the ball 11 (the state shown in FIG. 5), the ball 11 will come out of the ball seat 8*a*. That is, the ball joint 13 is disconnected, resulting in a failure in proper compressor operation.

It is, therefore, necessary to restrict the rotation of the ball 11 relative to the piston 8, to thereby perform the function of the ball joint 13. Particularly where the ring 12 and the ball 11 are fixed on the rod portion 10 of the connecting rod 9, the piston 8 must be prevented from rotating in relation to the ball 11.

FIGS. 10 to 18 show a structure for restricting the relative rotation of the ball 11 and the piston 8, which will hereinafter be explained in detail.

Figure 10:
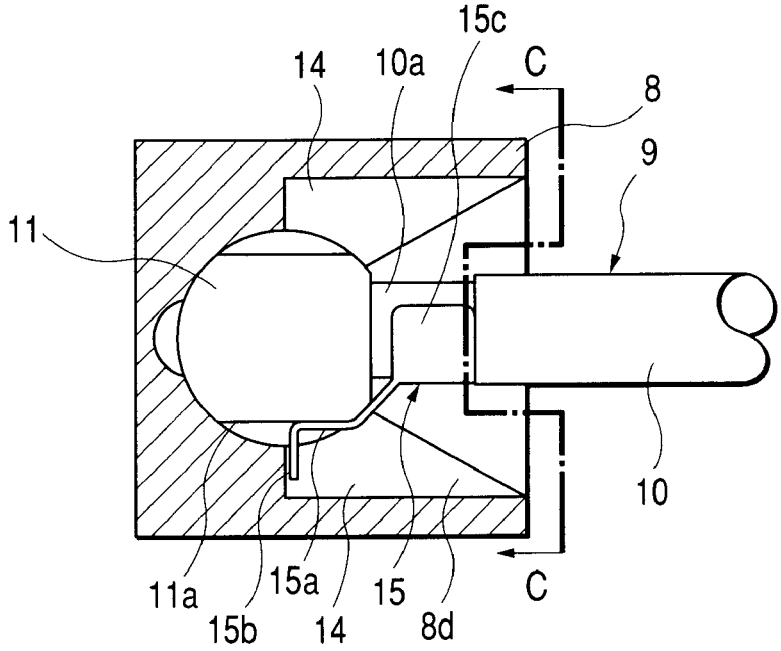
FIG. 10 is a longitudinal sectional view showing an example of stopper fabricated from an elastic steel sheet for regulating piston rotation.
Figure 11:
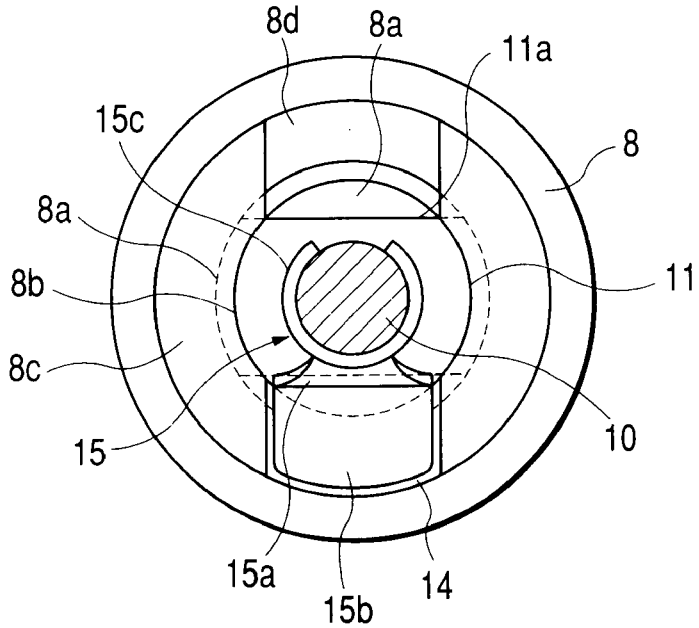
FIG. 11 is a sectional view taken along line C—C of FIG. 10.
Figure 12:
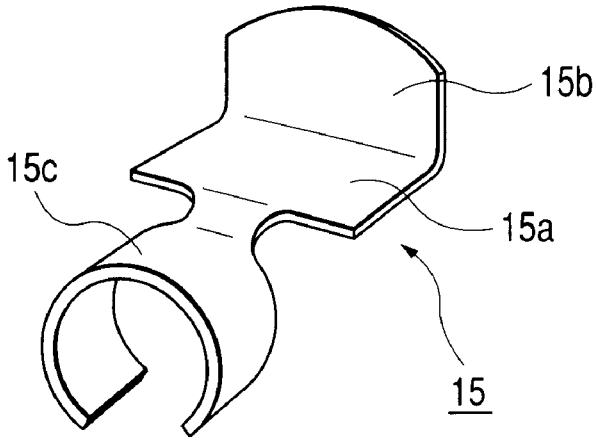
FIG. 12 is a perspective view showing an example of the shape of the stopper used in FIG. 10.

FIGS. 10, 11 (sectional view taken along line C—C of FIG. 10), and 12 (perspective view seen from a stopper 15 described later) show by way of example the stopper 15 provided to restrict the rotation of the piston 8 and the ball 11. FIG. 10 is a longitudinal sectional view of the crankshaft 6 with the stopper 15 installed on the structure that the connecting rod 9 is assembled to the piston 8. FIG. 12 shows one example of the stopper 15 formed of an elastic steel sheet.

The stopper 15 has a flat portion 15*a* which is closely attached on the flat cut portion 11*a* of the ball 11, and is provided with a rising portion 15*b* on the forward end. On the opposite side of the rising portion 15*b*, a circular portion 15*c* having an opening of appropriate width continues to the flat portion 15*a*.

The rising portion 15*b*, as shown in FIG. 11, is inserted, with an appropriate amount of clearance provided, into the space 14 formed by the insertion groove 8*d* of the piston 8 and the flat cut portion 11*a* of the ball 11. The circular portion 15*c* is placed in the stepped area 10*a* of the rod portion 10 (rolled around and crimped to the rod portion 10). The stopper 15 can be securely installed by firmly attaching the flat portion 15*a* to the flat cut portion 11*a* of the ball 11 and by crimping the circular portion 15*c* as stated above. The rotation of the piston 8 is restricted by interference of the rising portion 15*b* inserted into the space 14 and the insertion groove 8*d*.

Figure 13:
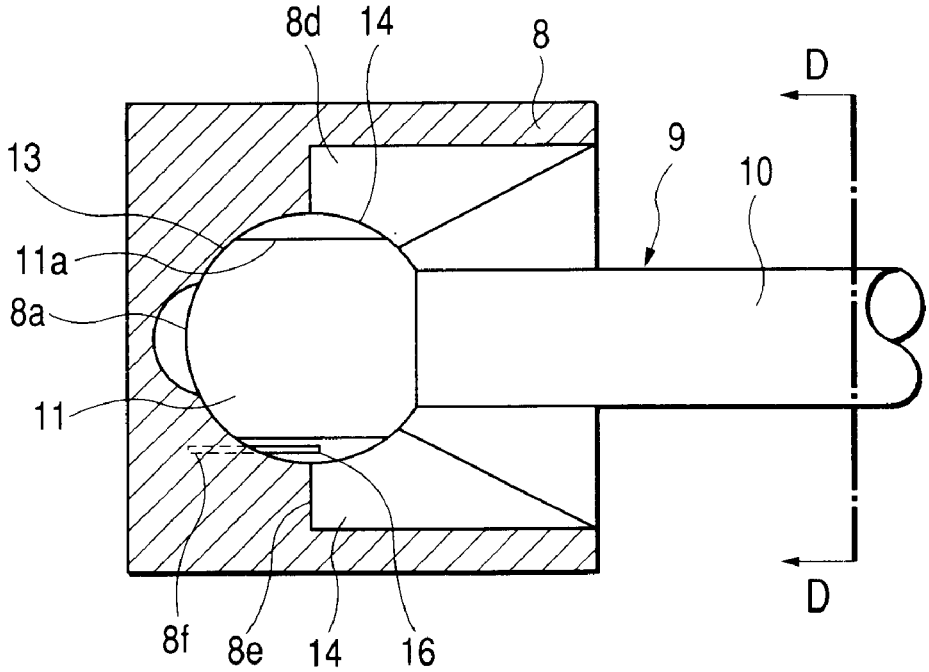
FIG. 13 is a longitudinal sectional view showing an example of a stopper fabricated from a spring pin for regulating piston rotation.
Figure 14:
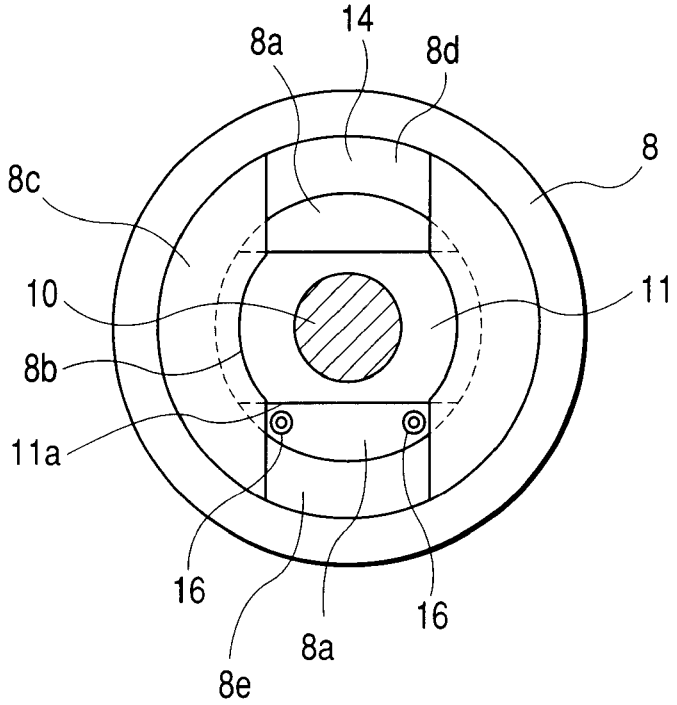
FIG. 14 is a sectional view taken along line D—D of FIG. 13.

FIGS. 13 and 14 (a sectional view taken along line D—D of FIG. 13), similarly to the stopper 15, show another example of the structure which restricts the rotation of the piston 8. FIG. 13 is a longitudinal sectional view showing the piston 8 installed in the cylinder 7.

With the connecting rod 9 installed to the piston 8, a spring pin 16 is pressed into a hole 8*f* formed by drilling in the surface of the ball seat 8*a* which communicates with the space 14. The spring pin 16 is designed to interfere with the ball 11 of the connecting rod 9 when the piston 8 turns, thereby restricting the rotation of the piston 8.

Figure 15:
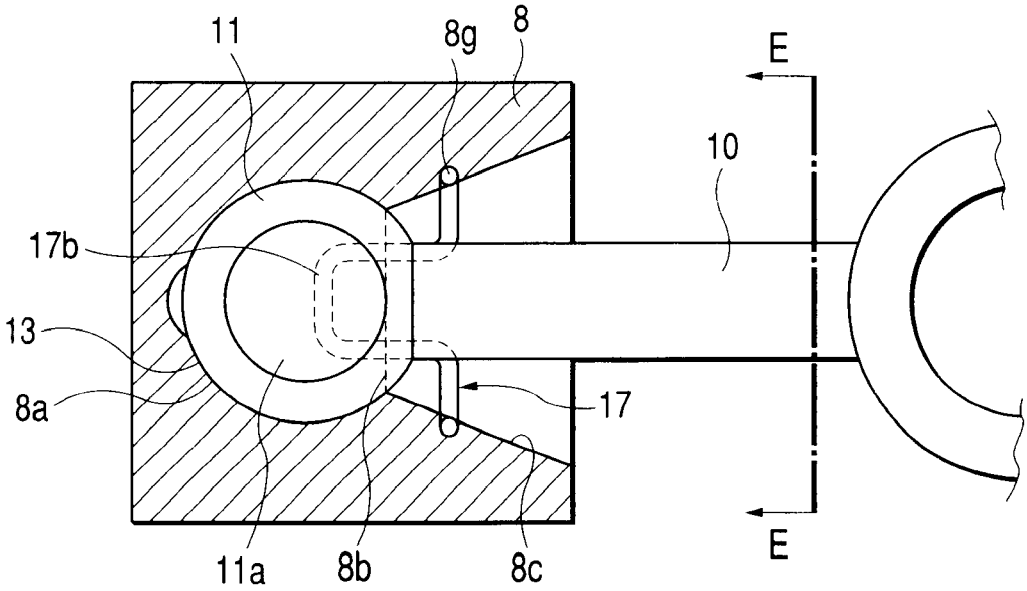
FIG. 15 is a transverse sectional view showing an example of the stopper fabricated from a piano wire for regulating piston rotation.
Figure 16:
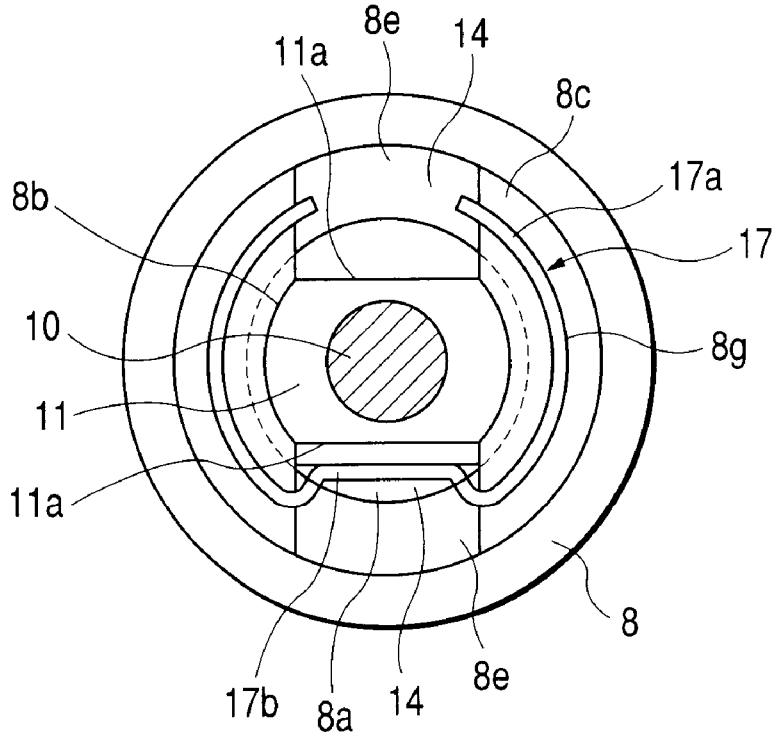
FIG. 16 is a sectional view taken along line E—E of FIG. 15.

Furthermore, FIGS. 15, 16 (a sectional view taken along line E—E of FIG. 15), and 17 (a perspective view of the stopper 17) show one example of the stopper 17 produced of a piano wire. FIG. 15 is a transverse sectional view from the direction of the crankshaft, showing the structure of the piston 8 assembled with the connecting rod 9 and furthermore fitted with the stopper 17.

Next, by referring to FIG. 16 which is a sectional view taken along line E—E of FIG. 15, the structure for installing the stopper 17 will be explained. There is provided a circular groove 8*g* in any arbitrary position in the slanting surface portion of the funnel-shaped hole 8*c* which is an opening of the piston 8 (the groove may be formed by cutting in the slanting surface). The circular portion 17*a* of the stopper 17 is fitted in the circular groove 8*g*.

Figure 17:
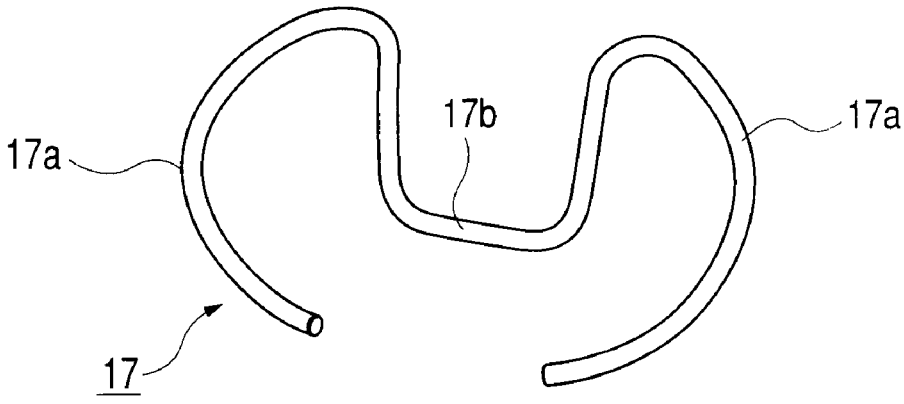
FIG. 17 is a perspective view showing an example of the stopper used in FIG. 15.

The stopper 17 has at least one circular portion 17*a*; in the embodiment disclosed in FIG. 17, the stopper has two circular portions 17*a*. A projection 17*b* is provided between these circular portions 17*a*. The width of the projection 17*b* is much the same as, or a little smaller than, that of the insertion groove 8*d* of the piston 8, that is, the width between the flat cut portions 11*a* of the ball 11.

When the circular portion 17*a* is fitted in the circular groove 8*a*, the projections 17*b* are set in the space 14 formed by the insertion groove 8*d* of the piston 8 and the flat cut portions 11*a* of the ball 11. In this state, the stopper 27 is fixed. The circular portion 17*a* of the stopper 17, as shown in FIG. 17, is formed expanded in relation to the projection 17*b*, thus being fitted with a spring force in the circular groove 8*g*.

The projection 17*b* thus inserted in the space 14 restricts the rotation of the piston 8.

In the embodiments of the above-described three types of stoppers used in such a closed compressor that the lubricating oil is supplied from the end of the crankshaft 6, it is desirable that the rotation restricting portion of the stopper be disposed in the space 14 on the lower side of the center of the piston 8, that is, on the shaft 5 side, not on the end side of the crankshaft 6.

Figure 18:
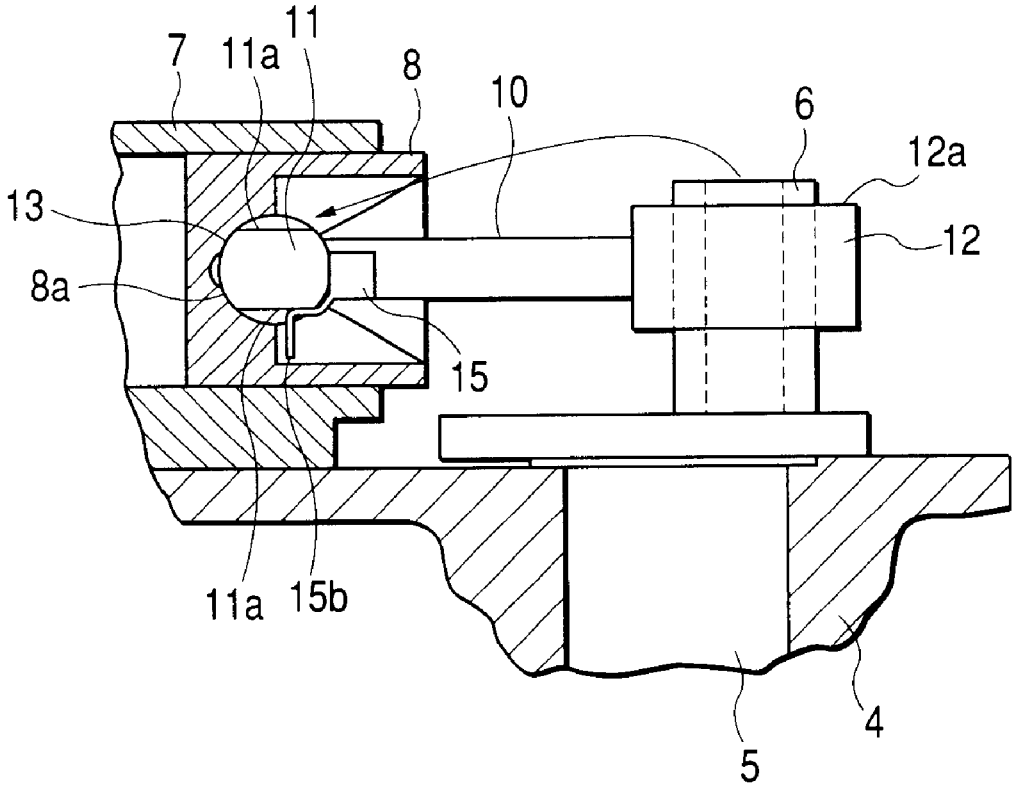
FIG. 18 is a longitudinal sectional view showing an example a method for supplying the lubricating oil to a ball section formed by the ball joint method according to this invention.
Figure 19:
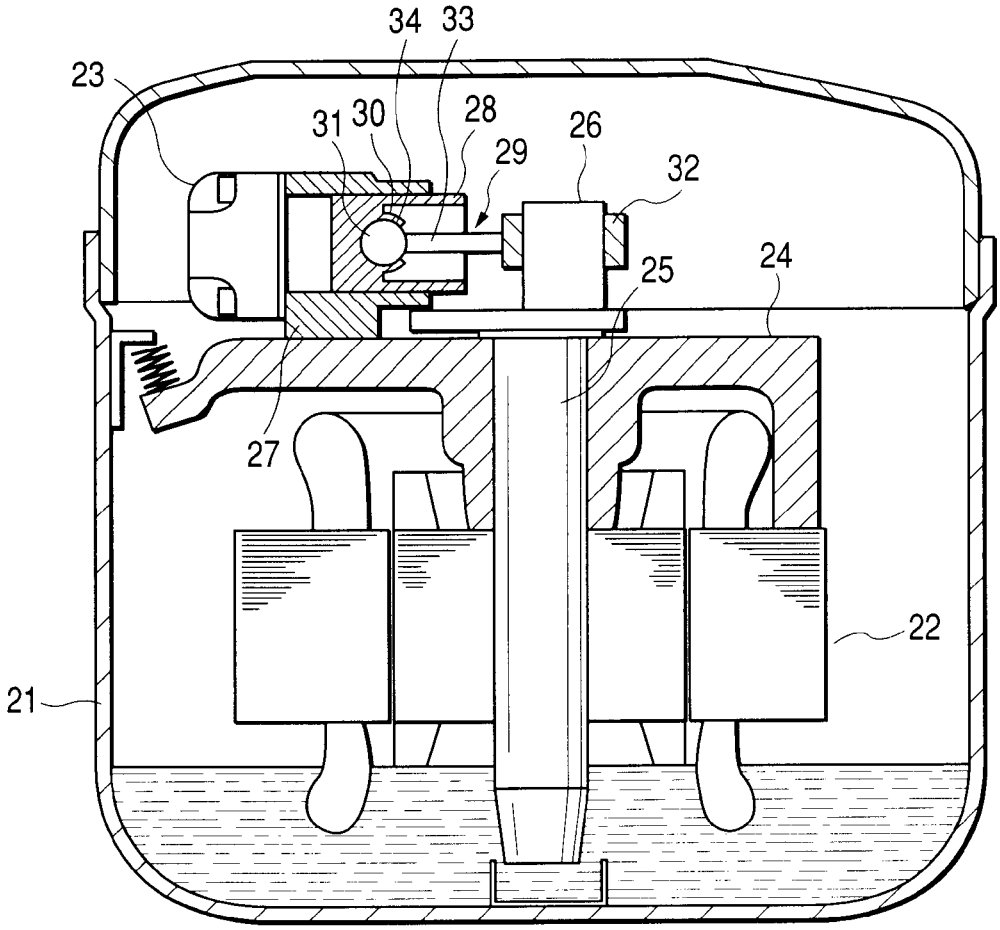
FIG. 19 is a longitudinal sectional view showing an example of the ball joint method adopted in a conventional known closed compressor.
Figure 20:
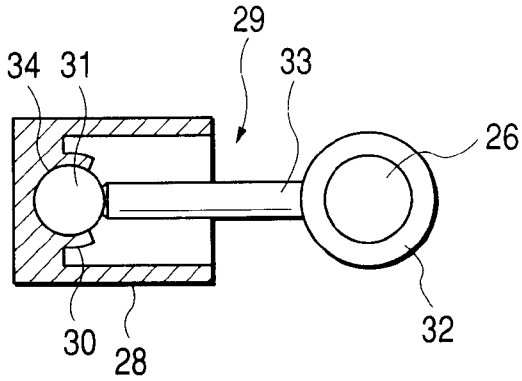
FIG. 20 is a transverse sectional view showing an example of the conventional ball joint.

As shown in FIG. 18, opening the upper space 14 as an open space permits the flow of the lubricating oil fed from the forward end of the crankshaft, directly to the flat cut portion 11*a* of the ball 11 as indicated by an arrow when the closed compressor is operated. The flat cut portion 11*a* faces the ball seat 8*a*, and therefore the lubricating oil that has reached the upper part of the flat cut portion 11*a* directly reaches the ball seat 8*a*, thereby performing proper lubrication to the whole part of the ball joint section 13.

In the case of the lubrication system that the lubricating oil is supplied from for instance the top of the shaft 5, not from the end of the crankshaft 6, the lower space 14 is opened to feed the lubricating oil to the ball seat 8*a*.

According to this invention described above, it is possible to ensure sufficient application of the lubricating oil to the sliding surface of the ball joint, to thereby enable achieving smooth operation and high reliability of the closed compressor.

What is claimed is:

1. A closed compressor comprising: a crankshaft for transmitting a torque from an electric motor; a piston provided with a ball seat having a spherical section on the crankshaft side; and a connecting rod having a ball portion on one end for connection with said ball seat, a ring portion on the other end which fits on said crankshaft, and a rod portion for connection between said ring portion and said ball portion;

said ball portion having two flat surfaces which are in parallel with the open end faces of said ring portion; said ball seat provided with an insertion port which has at least the same width as the width between said two flat surfaces of said ball portion; and a space formed by said flat surfaces of said ball portion, said insertion port, and a spherical section of said ball seat.

2. A closed compressor according to claim 1, wherein said flat surfaces of said ball portion and said insertion portion of said ball seat are formed approximately at right angles.

3. A closed compressor according to claim 1, having a restricting member for restricting the rotation of said ball and said piston which have an insertion portion in said space.

4. A closed compressor according to claim 3, wherein said restricting member is provided with a flat portion which is closely brought into contact with at least one of said flat surfaces of said ball portion, an inserting portion having a rising portion at the forward end of said flat portion, and a fixing portion which is connected to said inserting portion, fitting on said rod portion of said connecting rod.

5. A closed compressor according to claim 3, wherein said restricting member is a pin inserted in a hole provided in said spherical section.

6. A closed compressor according to claim 3, wherein there is provided a circular groove between said ball seat in said piston and the end portion of said piston, and said restricting member is a ring made of a steel wire having a projection to be inserted in said space.

7. A ball joint method of a closed compressor having a ball on one end of a connecting rod which connects a piston to a crankshaft, said ball being slidably connected to a ball seat formed in said piston, wherein said ball is provided with flat cut portions on both sides of its outside diameter, with cut surfaces mutually opposed, in parallel with the end faces of a crankshaft formed on the opposite side of said ball of said connecting rod and a ring portion sliding on said crankshaft; an insertion groove is provided in said ball seat of said piston to allow the insertion of said ball having said flat cut portions; and after the insertion of said ball in a slidable state into said ball seat via said insertion groove, said ball and said piston are turned through about 90 degrees, to thereby form spaces between said insertion groove of said piston and said flat cut portions of said ball, exposing a part of said ball seat of said piston.

8. A ball joint method of a closed compressor according to claim 7, wherein after the insertion of said ball in a slidable state into said ball seat via said insertion groove of said piston, said ball and said piston are turned through about 90 degrees, and an obstacle having an arbitrary amount of clearance is inserted on one side of said spaces which are formed in a vertical direction of said piston between said insertion groove of said piston and said flat cut portions of said ball, thereby restricting the range of rotation of said ball and said piston.

9. A ball joint method of a closed compressor according to claim 8 having a means of restricting the range of rotation of said ball and said piston, wherein said obstacle for restricting the rotation of both is made of an elastic steel sheet, which has a flat portion to be firmly attached on one of said flat cut portions of said ball, a rising portion provided as an obstacle portion at the forward end of said flat portion, and a circular portion formed on the opposite side of the obstacle portion via said flat portion; said circular portion being fixedly fitted on the stepped portion of the outside diameter of said rod portion, to restrict the range of rotation of said ball and said piston.

10. A ball joint method of a closed compressor according to claim 8 having a means of restricting the range of rotation of said ball and said piston, wherein a hole is provided on one side of said insertion groove of said piston; and after fitting said ball in said piston, a spring pin is inserted in said hole which is open to said insertion groove, thereby restricting the range of rotation of said ball and said piston.

11. A ball joint method of a closed compressor according to claim 8 having a means of restricting the range of rotation of said ball and said piston, wherein a circular groove is provided in an arbitrary portion on the inside diameter side of said piston; and a ring made of a piano wire having a projection to be inserted into a space formed by said insertion groove and said flat cut portion of said ball is inserted into said circular groove, thereby restricting the range of rotation of said ball and said piston.

* * * * *